US009505467B2

(12) United States Patent
Canaris

(10) Patent No.: US 9,505,467 B2
(45) Date of Patent: Nov. 29, 2016

(54) BOAT BOARDING AID

(71) Applicant: John Canaris, Heritage Park (AU)

(72) Inventor: John Fredrick Canaris, Heritage Park (AU)

( * ) Notice: Subject to any disclaimer, the term of this patent is extended or adjusted under 35 U.S.C. 154(b) by 0 days.

(21) Appl. No.: 14/912,254

(22) PCT Filed: Aug. 17, 2014

(86) PCT No.: PCT/IB2014/063944
§ 371 (c)(1),
(2) Date: Feb. 16, 2016

(87) PCT Pub. No.: WO2015/025256
PCT Pub. Date: Feb. 26, 2015

(65) Prior Publication Data

US 2016/0194059 A1 Jul. 7, 2016

(30) Foreign Application Priority Data

Aug. 21, 2013 (AU) ..... 2013903152

(51) Int. Cl.
*B63B 21/10* (2006.01)
*B63B 27/14* (2006.01)

(52) U.S. Cl.
CPC ..... *B63B 27/146* (2013.01); *B63B 21/10* (2013.01)

(58) Field of Classification Search
CPC ..... B63B 27/146; B63B 27/14
See application file for complete search history.

(56) References Cited

U.S. PATENT DOCUMENTS 2,669,733 A * 2/1954 Picker ..... B63B 27/14 114/264
3,828,707 A * 8/1974 Young ..... B63B 27/14 114/362
4,926,965 A * 5/1990 Fox ..... B63B 27/14 114/362
5,123,372 A * 6/1992 Kobayashi ..... B63B 27/14 114/362

* cited by examiner

*Primary Examiner* — Edwin Swinehart
(74) *Attorney, Agent, or Firm* — Abelman, Frayne & Schwab

(57) ABSTRACT

This invention provides a boarding aid [40] for small boats such as a trailer boats [57] which has a rigid stirrup assembly [59] incorporating a foot support [46] which pivots about a transverse axle [44] for the bow roller [56] between an on-deck stowed position to a deployed position at which it is stably supported by abutment against a stop [47] associated with and spaced from the axle [44]. The axle [44] and the stop [47] are part of a support frame assembly [58] which mounts to the boat's foredeck [48]. When the rigid stirrup assembly [59] pivots to its deployed position it is held stably by the abutment [47] in a position at which the foot support [46] is below and forwardly of the bow roller [56]. The boat is also provided with opposed bow rails [50, 51] which may be gripped to enable a user to elevate themselves from the foot support, onto the foredeck [48].

9 Claims, 4 Drawing Sheets

BOAT BOARDING AID

This invention relates to a boarding aid for small vessels such as trailer boats.

TECHNICAL FIELD

Trailer boats are often launched from and retrieved from purpose built multi-lane ramps which can become congested during busy periods. Typically a trailer borne boat is reversed stern first into the water to a position from which it may be pushed and floated away from the trailer. As most boats are much easier to board from the stern where the freeboard is lower, the launched boat is often turned around to enable the occupants to board from the rear where boarding platforms and the like are typically provided to assist this activity.

During busy periods when several boats may be floating side by side in the water at the bottom of the ramp there may not be available space to rotate the boat, necessitating boarding from the side or the bow, which can be difficult, or wading to the rear of the boat for boarding. In addition boats are often launched into a waterway which may have adverse conditions of wind and tide tending to move the boat away from its launched position and necessitating that the boat be held in position or risk it bumping into an adjacent boat. This can be a difficult task.

Launching and retrieving a trailer boat is made easier when the boat is configured for boarding at the bow so that the last person to board the boat can simultaneously push the boat stern first into open water and board across the bow.

BACKGROUND ART

There have been many attempts to provide steps or ladders which can be utilised to board a boat from the bow. However these have not been widely adopted due to their impractical nature as the bow or "pointy end" of a small boat is a very small area which is generally dominated by the boat's anchoring facilities and any interference in this area which adversely affects setting and retrieving an anchor is unacceptable, as a boat's anchor is a primary safety device.

A further difficulty when launching trailer boats arises due to the need for some of the passengers to board before the boat is launched. Boarding while the boat is on the trailer is often difficult unless special boarding ladders are provided. In addition it is not desirable for the passengers to be aboard while the boat is trailer borne and being transported to the boat launching ramp. Thus boarding and disembarking at a launching ramp often occurs when the boat is floating and this is also undesirable.

This invention aims to provide a boat boarding aid which will facilitate boarding a vessel at the bow during launching from a trailer and in other situations such as at a shoaling beach where it is desirable to motor off stern first to maintain the stern and driving propeller(s) in navigable water.

SUMMARY OF INVENTION

With the foregoing in view, this invention in one aspect resides broadly in a method of providing a trailer boat with a boarding aid, including:

providing a rigid stirrup assembly pivotally connected to the boat's bow whereby the rigid stirrup assembly may be pivoted from a stowed position behind the bow to a stable deployed position in front of the boat's stern at which the rigid stirrup assembly provides a foot support below and forwardly of its pivotal connection to the boat. The deployed foot support may be utilised by a user to elevate themselves above the bow and board the boat over the bow.

An advantage of this arrangement is that the rigid stirrup assembly may pivot freely toward its deployed position at which it is maintained by a suitable stop to hold the foot support forward of the pivot. Of course, if desired, such as for adjustability or to provide an alternative arrangement, the stop could be selectively engageable with the rigid stirrup assembly and be in the form of a retractable pin or the like. The stop means could also be abutment(s) on the boat or flexible or linkage type stays suspended from the bow or support rails on the bow for example. The support rails may be formed to provide handgrips to facilitate a user elevating themselves from the foot support and moving therefrom onto the foredeck and preferably the bow rails are formed as spaced apart rails to permit a user to move from the foot support onto the foredeck between the spaced hand rails. Of course the bow rail may be a continuous rail.

The rigid stirrup assembly may be pivotally connected to the boat's bow through a support frame which could be formed for removable connection to the foredeck. In such application the connection to the foredeck is preferably formed as a non-rotatable connection to the foredeck so that it secures the foot support stably in the deployed position even when loaded by athwartships loads as may be applied by a person boarding offset from the centreline of the boat. This is desirable as any substantial athwartships movement or fore and aft movement of the foot support would be undesirable as the user's foothold would feel unstable. Alternatively this stability could be provided by utilising suitable stop means in conjunction with the support frame or stop means in the form of a flexible or linkage type stays suspended from the bow rails, for example.

Providing an operatively stable foot support disposed forwardly of the anchor line guide affords a non-vertical path from the foot support to the foredeck which reduces the effort required to board the vessel compared to a vertical lift from the foot support to the foredeck. It also enables the foot support to be easily sighted from the foredeck for alighting from the boat. The angle between a vertical plane passing through the pivotal connection between the support frame assembly and the rigid stirrup assembly and a plane passing through said pivotal connection and the foot support when in its deployed position is in the range 20° to 50°. Preferably this angle is in the range of 30° to 40°.

The rigid stirrup assembly in its stowed position may rest in a substantially horizontal attitude on the boat's foredeck, or if there is no foredeck, it may pivot upward and rearward from its deployed position beyond a substantially horizontal stowed attitude, such as to lie alongside the rear side of the boat's stern.

The stirrup assembly may be in the form of a straight frame assembly which lies substantially flat on a foredeck or the stirrup assembly may be in the form of a cranked frame assembly having one frame portion which, when stowed, extends along the foredeck from the pivot and a second frame portion remote from the pivot which includes the foot support and which, when stowed, extends downward below the foredeck.

The method may further include providing an anchor line guide from which an anchor line may pass from line securing means across the foredeck and over the anchor line guide into the water, and forming the foredeck and/or line securing means such that the rigid stirrup assembly is supported beneath the deployed anchor line portion which extends across the foredeck.

The anchor line guide is suitably a bow roller supported for rotation about a bow roller axle and the pivot connection of the rigid stirrup assembly to the boat's bow is preferably co-axial with the bow roller axle. It is also preferred that the bow roller axle support is provided with abutment means which prevents rotation of the rigid stirrup assembly from its stowed position beyond said deployed position.

It is also preferred that the method includes providing the boat with spaced apart bow rails between which a user may pass from the deployed rigid stirrup assembly into the boat. The pivotal connection of the rigid stirrup assembly to the support frame assembly may limit pivotal movement whereby the foot support cannot be pivoted from its stowed position beyond its deployed position. Alternatively stop means co-operating with the support frame may be provided for holding the foot stirrup in its deployed position.

Preferably the pivotal connection is formed as a pivotal connection about a bow roller axle as this minimises the clutter on the foredeck and the bow roller axle is a strong point capable of supporting the weight of a user with safety and it is further preferred that stop means be formed on the bow roller support.

The anchor and line stowage may be an anchor well in the foredeck or it may be a designated area in the boat from which anchor line can pass to the foredeck area which is suitably provided with a bollard or cleat or other securing means which may be utilised to secure the anchor line to the boat. Preferably the securing means is positioned so that the anchor line passes from the anchor line guide to the securing means in spaced relationship with the foredeck. Alternatively the securing means may position the anchor line which extends rearward from the anchor line guide closely adjacent the foredeck so as to bear down on the stowed rigid stirrup assembly to hold it in position.

The rigid stirrup assembly may simply rest upon the foredeck or it may rest on saddles or rests or the like provided on the foredeck. Alternatively the foredeck may be formed with a recess or recess portions which substantially accommodate the rigid stirrup assembly so as to maintain a substantially unobstructed foredeck.

Preferably the foredeck is formed so as to support the rigid stirrup assembly in an unobtrusive manner beneath the anchor line portion which extends from the anchor line guide to the anchor/line stowage.

This invention also resides in a trailer boat provided with a boarding aid in accordance with one of the above methods.

In another aspect this invention resides broadly in a boarding aid including:

- a rigid stirrup assembly providing a foot support;
- a support frame assembly pivotally connected to the rigid stirrup assembly and adapted for incorporation into the bow of a boat whereby the rigid stirrup assembly may be pivoted from a stowed position behind the boat's bow to a deployed position in front of the boat's stern at which the foot support is below and forwardly of its pivotal connection to the support frame assembly, and
- stop means for stably supporting the rigid stirrup assembly in its deployed position.

Preferably the support frame assembly is formed as an anchor line guide which may include a fairlead or other line constraining means. More preferably the anchor line guide is a bow roller arranged for rotation about a bow roller axle extending between spaced axle supports of the support frame assembly and which may be spaced upright apertured lugs welded to the foredeck of a metal boat, formed integrally with a composite boat or forming the forward part of a bow roller support assembly bolted to the foredeck.

The rigid stirrup assembly may include a mounting frame extending from the pivot connection to the foot support which may be of conventional stirrup shape and the mounting frame may be a central rigid spine assembly which may, if desired, telescope for length adjustment, or adjustment between stowed and deployed attitudes. The rigid stirrup assembly may be formed as an elongate U-shaped frame having side members pivotally attached to the bow roller axle at their spaced ends and an interconnecting base portion which forms the foot support. The rigid stirrup assembly could also be formed as an open frame such as an L-shaped frame if desired or as a ladder-type frame to provide one or more foot supports.

This invention may also be provided as an aftermarket accessory or the like which may be fitted to a boat to facilitate boarding the boat via the bow. For this purpose the support means may be a formed of aluminium and be provided with weld zones for welding to the foredeck of an aluminium boat. Alternatively the support means may include an apertured base wall through which the support means may be mechanically secured to a foredeck.

Where the support frame cannot be pivotally connected to the bow roller axle at the outside of the spaced supports, the bow roller may be removed to permit the support frame to connect to the bow roller axle between the spaced supports and to extend to the foot stirrup. In such applications a narrower bow roller may be utilised to permit the connection to be made on the support frame.

Alternatively the bow roller may be removed and the support frame may carry a further pair of spaced supports for supporting a bow roller in a position above and/or forwardly of the position of the removed bow roller. The further pair of spaced supports may be fixed directly to the support frame to support the bow roller which in the deployed position may engage the stern of the boat so as to form the abutment for maintaining the foot stirrup in its deployed attitude. The further pair of spaced supports may provide a series of mounting apertures for the bow roller to enable this abutment to be adjusted.

The further pair of spaced supports may be pivotally connected to the support frame so as to hang downwardly from their pivotal connection to the support frame when disposed in the deployed position to clear the space between the upper portion of the support frame and the stern of the boat. Latching means may be provided to secure the support frame and the bow roller supported thereby in its anchor line guide position.

In yet a further aspect this invention resides broadly in a trailer boat having a boarding aid as defined in any one of the aspects defined above.

BRIEF DESCRIPTION OF DRAWINGS

In order that this invention may be more readily understood and put into practical effect reference will now be made to the accompanying drawings which illustrate typical embodiments of the invention and wherein.

DESCRIPTION OF EMBODIMENTS

Figure 1:
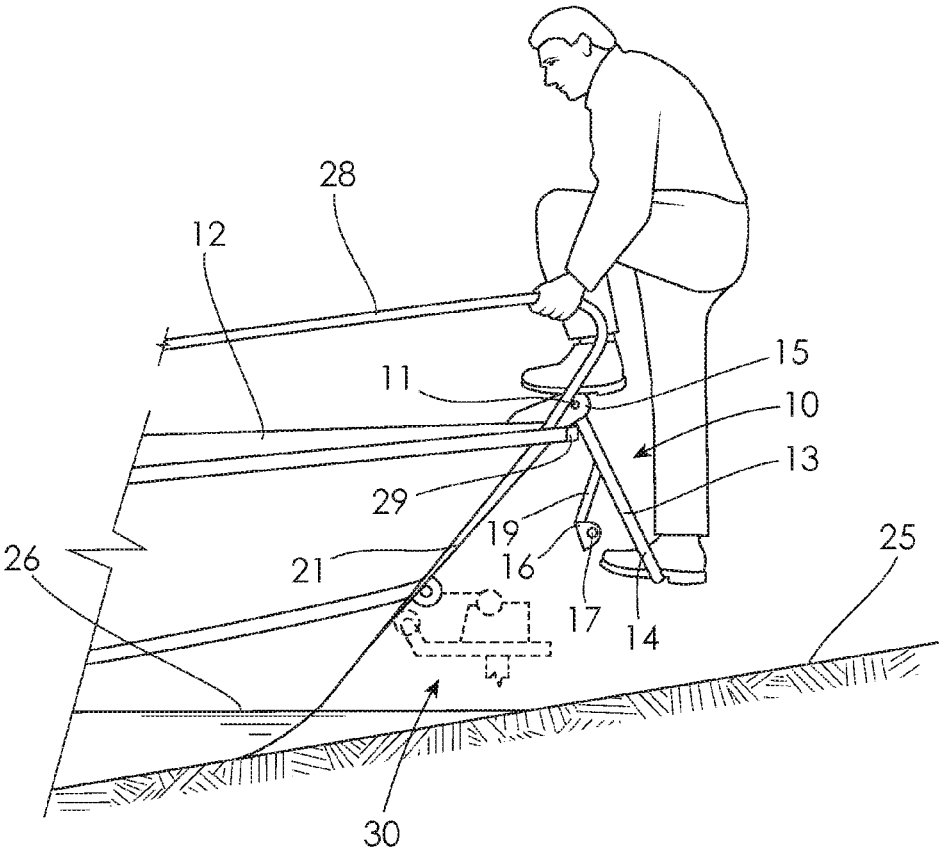
FIG. 1 is a side view illustrating one embodiment of the present invention in the deployed attitude.
Figure 2:
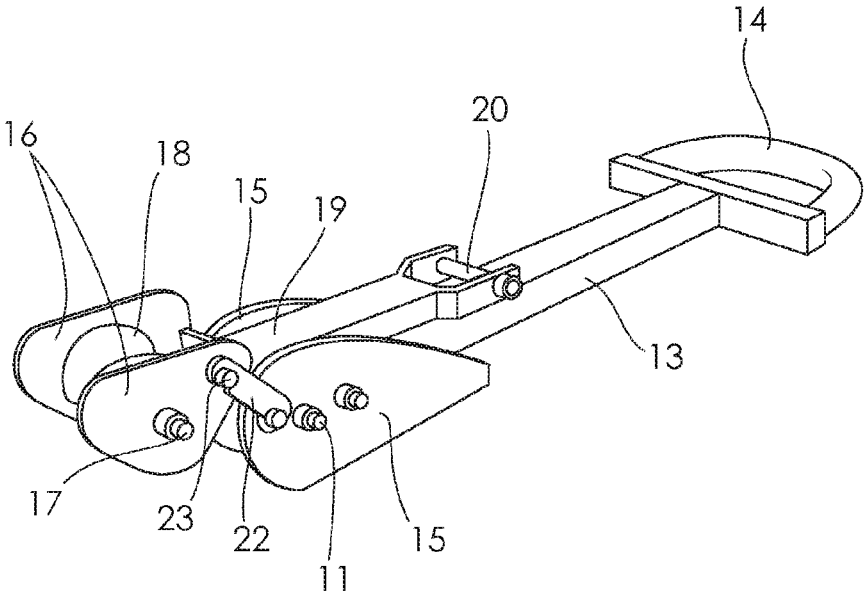
FIG. 2 is a perspective view of the boarding aid illustrated in FIG. 1.

The boat launching and boarding aid 10 illustrated in FIG. 1 and FIG. 2 is adapted to be connected to the bow roller support axle 11 for pivotal movement between its deployed position, as illustrated, to a stowed position at which the aid 10 rests on the foredeck 12 of a boat, the front portion of which is illustrated in the drawings. In this embodiment the bow roller which is normally supported about the roller support axle 11 is removed so that the central spine frame 13, which extends between the support axle 11 and the foot stirrup 14, can pass between the spaced flanges 15 which support the roller support axle 11.

A further pair of spaced support flanges 16 supports a bow roller axle 17 and a bow roller 18 and these flanges are attached to a further frame member 19 which pivotally attaches to the spine 13 at 20 so that in the deployed position the bow roller 18 and its supporting frame member 19 hang freely from the underside of the spine 13 forwardly of the stern 21 of the boat. In the stowed attitude, as illustrated in FIG. 2, the frame 19 rests on the portion of the spine 13 adjacent the axle 11 so as to support the bow roller 18 above and forwardly of the removed bow roller and a latching member 22 pivotally connected to one support flange 16 can latch about a pin 23 on the spaced flanges 15 to secure the bow roller 18 in its operative position.

In FIG. 1 the bow section of the boat is illustrated resting upon a boat ramp 25 with the water level illustrated at 26 such that upon rearward movement the boat will float from the ramp 25. When the boarding aid 10 is deployed as illustrated, a user may put one foot in the stirrup 14 and push the boat rearward with the other foot to float the boat away from the ramp 25. Thereupon the user may elevate their body above the foredeck 12 and position their other foot on the foredeck, moving it to that position between the spaced bow rails 28 which may be used as convenient handholds.

As soon as the user has boarded the boat the aid 10 may be pivoted from its deployed position onto the foredeck such that the bow roller is ready for use. Preferably the latching member 22 is engaged about the latching pin 23 to prevent upward movement of the bow roller 18 under the influence of the anchor line tension. It will be seen that in the deployed position the spine 13 engages a stop 29 on the bow which prevents its rotation beyond the downwardly and forwardly inclined attitude illustrated. This holds the foot stirrup 14 in a convenient forward position to assist movement of the user's unsupported leg onto the foredeck when boarding and when used to disembark the boat from the bow this configuration places the foot stirrup in a clearly visible position from which a user may confidently step onto or from the foredeck even when facing forwards.

In addition it will be seen that the forward deployment of the foot stirrup 14 places the stirrup 14 in front of the boat winch, as shown in dotted outline at 30, when the boat is supported on its trailer. Accordingly the aid 10 assists in boarding the boat from the trailer. Thus passengers may board the trailer borne boat over the bow before the boat is floated from its supporting trailer and of course the passengers may disembark via the boarding aid 10.

Figure 3:
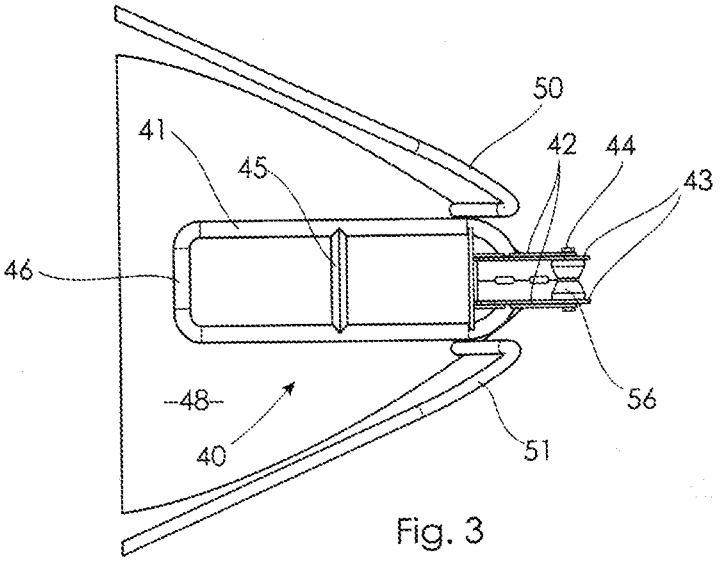
FIG. 3 is a plan view illustrating a further embodiment of the invention disposed in its operative position on a foredeck.
Figure 4:
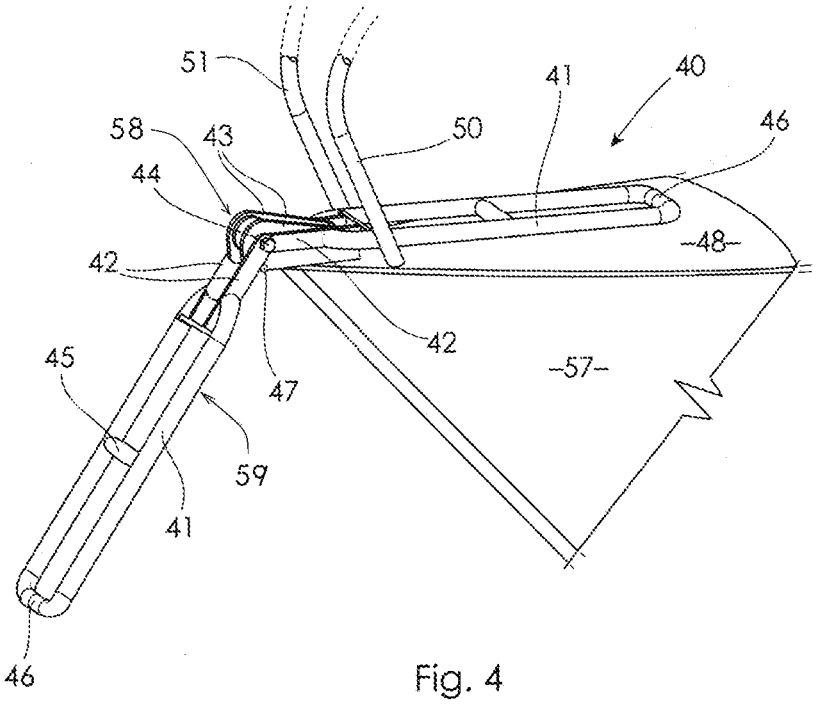
FIG. 4 is a perspective view of the arrangement illustrated in FIG. 3 and showing the boat launching and boarding aid illustrated in FIG. 3 disposed in both the stowed position and the deployed position.
Figure 5:
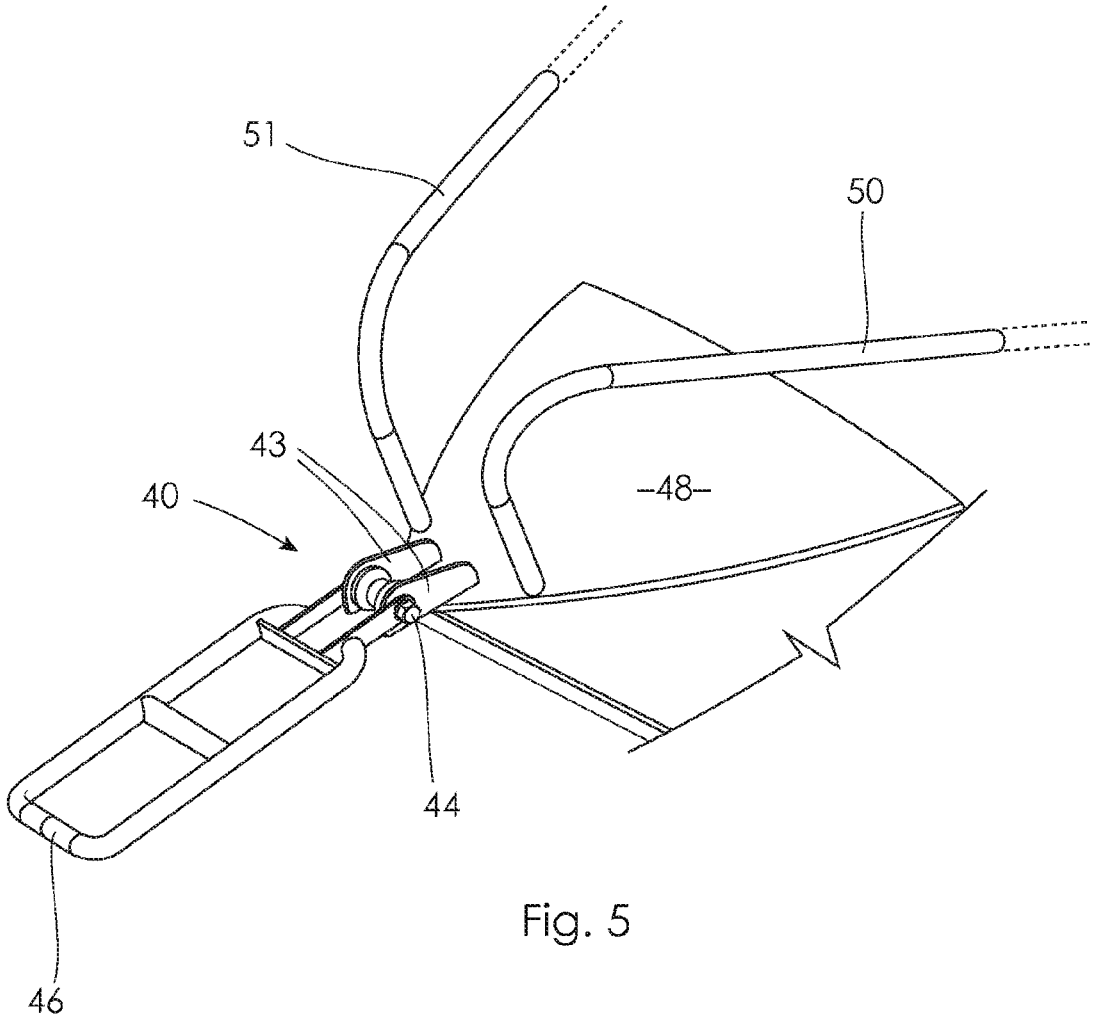
FIG. 5 is a further perspective view corresponding to FIG. 3 but illustrating the boat launching and boarding aid disposed in a boat control position.

The boarding aid 40 illustrated in FIGS. 3, 4 and 5 for a boat 57 utilises a rigid stirrup assembly 59 in the form of a U-shaped frame 41 provided with a pair of mounting flanges 42 extending from one end of the frame 41. The flanges 42 extend along the outside of the roller support flanges 43 which support the bow roller 56 and connect pivotally to the roller support axle 44. An intermediate rung or brace 45 is accommodated between the foot stirrup 46 and the mounting flanges 42 which may be utilised as a further step if required. In this embodiment, as illustrated in FIG. 4 the support frame assembly 58 includes roller support flanges 43 which support an abutment pin 47 against which the underside of the flanges 42 abut when the boarding aid 40 is pivoted from its stowed position on the foredeck 48 to its deployed position so as to hold the boarding aid stably in a position extending downwardly and forwardly from the roller support axle 44.

Use of the boarding aid 40 in conjunction with use of the spaced bow rails 50 and 51 will assist users in boarding and disembarking a boat across the foredeck as described for the embodiments illustrated in FIGS. 3 and 4. In addition the boarding aid 40 (or the boarding aid 10) when disposed in a forwardly projecting position can be utilised as a handhold to assist in positioning or holding the floating boat at a ramp or a sloping shore, for example, from a more elevated position in shallower water than would otherwise be possible. The boarding aid 40 or the aid 10 could be provided with suitable latching means for holding it in this forwardly extending attitude to provide a fixed handhold for controlling the boat, however it is considered that the rigid nature of the boarding aid will provide an effective control handle which can be pivoted up or down to suit the conditions and or the user.

Figure 6:
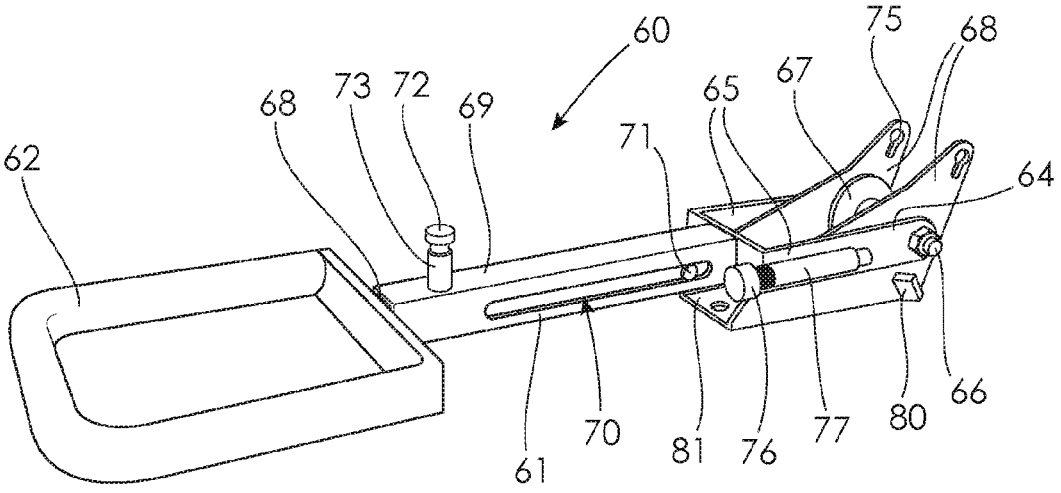
FIG. 6 is a perspective view illustrating a further embodiment of this invention.

The boarding aid 60 illustrated in FIG. 6 is similar to the embodiment illustrated in FIGS. 1 and 2 in that it utilises a spine frame 61 extending between the foot stirrup 62 and the bow roller axle 63. However in this embodiment a U-shaped mounting portion 64 extends about the external sides of the spaced flanges 65 which support the bow roller axle 66 and bow roller 67. In addition the spine frame 61 is formed as a telescopic assembly having an inner square-sectioned inner member 68 integral with the foot stirrup 62 which is received slidably and non-rotatable in a complementary square-sectioned outer tube 69 formed integrally with the U-shaped mounting portion 64. The tube 69 is slotted at 70 to accommodate a stop pin 71 which projects outwardly from the inner member 68. This pin 71 limits the extension of the inner member 68 from the outer tube 69.

The inner member 68 is also provided with a series of apertures along its upper face in which a lock pin 72 supported in the tubular housing 73 on the outer tube 69 may be selectively engaged to control the extended length of the telescopic spine assembly 61 which may be adjusted to suit the user. The telescopic spine assembly 61 also enables the overall length of the boarding aid 60 to be reduced for stowage on the foredeck. Where the foredeck is provided with an accommodating recess for the boarding aid, the adjustable length assists in correctly positioning the foot stirrup for accommodation within the accommodating recess.

The spaced flanges 65 in this embodiment extend upwardly beyond the roller 67 to provide keyhole shaped apertures 75 which enable a retaining pin 76 to be inserted therethrough to trap the anchor shaft or the anchor line between the flanges 65. This retaining pin 76 is normally retained in a tubular socket 77 supported on the U-shaped frame 64 as it must be removed from the apertures 75 to enable the closely fitting U-shaped frame 64 to pivot from the stowed position illustrated, to its deployed position. In the deployed position the underside faces of the opposed legs of the U-shaped frame 64 abut the stops 80 attached to the external faces of the flanges 65 so as to support the foot stirrup in its deployed position in front of the boat's stern and below and in front of the bow roller 67. The side flanges 65 extend upwardly from an apertured base 81 which may be bolted in a convenient position to the foredeck of a boat as required.

Figure 7:
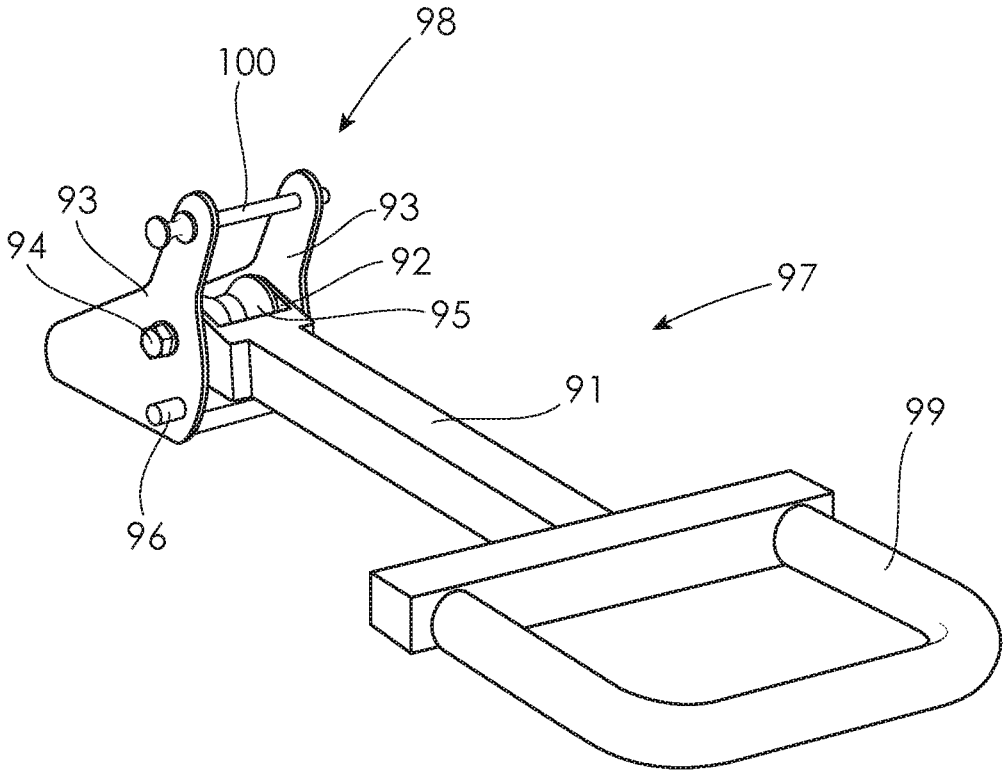
FIG. 7 is a perspective of a further embodiment of this invention.

The boarding aid 90 illustrated in FIG. 7 is similar to the embodiment illustrated in FIG. 6, however the spine frame 91 is non-adjustable and the U-shaped mounting portion 92 fits inside the axle supporting flanges 93 and the bow roller 95 is mounted on the axle 94 between the U-shaped mounting portion 92, the underside face of which rests against the abutment pin 96, also supported between the flanges 93, when the rigid stirrup assembly 97 is deployed. As illustrated the rigid stirrup assembly 97 is in an intermediate position extending in front of and substantially horizontally from the support assembly 98. In this attitude the foot support 99 can be used as a hand hold to assist in controlling the floating movement of the boat to which it is attached. A retractable anchor line retaining pin 100 is also supported in upper extensions of the flanges 93.

From the above it will be seen that several of the significant difficulties and safety aspects associated with launching and boarding a trailer boat at a public boat ramp are significantly reduced by utilising aspects of the present invention, namely boarding a trailer boat while it is supported on its trailer, controlling the position of the trailer boat at the ramp after launching and boarding the trailer boat via the bow so that it can be pushed away from the ramp stern first into deeper water while utilising minimum ramp space.

It will of course be realised that the above has been given only by way of illustrative example of the present invention and that all such modifications and variations thereto as would be apparent to persons skilled in the art are deemed to fall within the broad scope and ambit of this invention as is defined in the appended claims.

I claim:

1. A method of providing a trailer boat having a bow with a boarding aid, the bow including a stern at a forwardmost position of the boat, the method including:

providing a rigid stirrup assembly pivotally connected to the boat's bow whereby the rigid stirrup assembly may be pivoted from a stowed position behind the bow to a fixed deployed position in front of the boat's stern at which the rigid stirrup assembly provides a foot support below and forwardly of its pivotal connection to the boat;

providing an anchor line guide from which an anchor line may pass from line securing means across a foredeck and over the anchor line guide into the water, and forming the foredeck and/or line securing means such that the rigid stirrup assembly is supported beneath a deployed anchor line portion which extends across the foredeck.

2. The method as claimed in claim 1, wherein the anchor line guide is a bow roller supported for rotation about a bow roller axle and wherein the pivot connection of the rigid stirrup assembly to the boat's bow is co-axial with the bow roller axle.

3. The method as claimed in claim 1, wherein the bow roller axle support is provided with abutment means which prevents forward rotation of the rigid stirrup assembly beyond said deployed position.

4. The method as claimed in claim 1 and further including providing spaced apart bow rails between which a user may pass from the deployed rigid stirrup assembly into the boat.

5. A trailer boat provided with a boarding aid in accordance with the method of claim 1.

6. A boarding aid for a boat having a bow, and wherein the bow includes a stern at a forwardmost position of the boat, the boarding aid including:

a rigid stirrup assembly providing a foot support;

a support frame assembly pivotally connected to the rigid stirrup assembly and adapted for incorporation at the bow of the boat whereby the rigid stirrup assembly may be pivoted from a stowed position behind the boat's bow to a deployed position in front of the boat's stern at which the foot support is below and forwardly of its pivotal connection to the support frame assembly; and stop means for holding the rigid stirrup assembly in its deployed position;

wherein the support frame assembly is formed as a bow roller assembly having a bow roller supported for rotation about a bow roller axle and wherein the pivot connection of the rigid stirrup assembly to the boat's bow is a pivot connection about the bow roller axle.

7. A boarding aid as claimed in claim 6, wherein the stop means is on the support frame assembly.

8. The boarding aid as claimed in claim 6, wherein the stop means is an abutment on the bow roller assembly radially spaced from the roller axle and engaged by the rigid stirrup assembly when pivoted to its deployed position.

9. The boarding aid as claimed in claim 6, wherein the angle between a vertical plane passing through the pivotal connection between the support frame assembly and the rigid stirrup assembly and a plane passing through said pivotal connection and the foot support when in its deployed position is in the range 20° to 50°.

* * * * *